US006194826B1

(12) United States Patent
Satou et al.

(10) Patent No.: US 6,194,826 B1
(45) Date of Patent: Feb. 27, 2001

(54) PROCESS FOR PREPARING PHOSPHOR PATTERN, PHOSPHOR PATTERN PREPARED THE SAME AND BACK PLATE FOR PLASMA DISPLAY PANEL

(75) Inventors: Kazuya Satou, Hitachi; Hiroyuki Tanaka, Mito; Takeshi Nojiri, Ibaraki-ken; Naoki Kimura, Hitachi; Toranosuke Ashizawa, Hitachinaka; Seiji Tai, Hitachi; Ikuo Mukai, Hitachi; Seikichi Tanno, Hitachi, all of (JP)

(73) Assignee: Hitachi Chemical Co., Ltd., Tokyo (JP)

( * ) Notice: Subject to any disclaimer, the term of this patent is extended or adjusted under 35 U.S.C. 154(b) by 0 days.

(21) Appl. No.: 09/038,286

(22) Filed: Mar. 11, 1998

(30) Foreign Application Priority Data

Mar. 11, 1997 (JP) ..... 9-056748

(51) Int. Cl.[7] ..... H01J 1/62; H01J 63/04
(52) U.S. Cl. ..... 313/485; 445/52; 430/24
(58) Field of Search ..... 313/485, 498–506, 313/483–494, 581–586; 445/23, 24, 52; 430/24

(56) References Cited

U.S. PATENT DOCUMENTS 5,698,268 * 12/1997 Takagi ..... 427/437
5,858,616 * 1/1999 Tanaka et al . ..... 430/281.1

FOREIGN PATENT DOCUMENTS

0768573A1 4/1997 (EP) .
0785565A1 7/1997 (EP) .

OTHER PUBLICATIONS

Patent Abstracts of Japan, Publication No. 10198026, Jul. 31, 1998, Application No. 09004204, Jan. 14, 1997.
Patent Abstracts of Japan, Publication No. 10092313, Apr. 10, 1998, Application No. 09043065, Feb. 27, 1997.
Patent Abstracts of Japan, Publication No. 10186643, Jul. 14, 1998, Application No. 08349250, Dec. 27, 1996.
Patent Abstracts of Japan, Publication No. 10186644, Jul. 14, 1998, Application No. 08349251, Dec. 27, 1996.
Patent Abstracts of Japan, Publication No. 10186645, Jul. 14, 1998, Application No. 08349252, Dec. 27, 1996.
Patent Abstracts of Japan, Publication No. 09265184, Oct. 7, 1997, Application No. 08075530, Mar. 29, 1996.

* cited by examiner

*Primary Examiner*—Nimeshkumar D. Patel
*Assistant Examiner*—Matthew J. Gerike
(74) *Attorney, Agent, or Firm*—Antonelli, Terry, Stout & Kraus, LLP

(57) ABSTRACT

Disclosed are a process for preparing a phosphor pattern of the present invention comprises the steps of:

(I) forming a phosphor-containing photosensitive resin composition layer (A) on a substrate having unevenness,
(II) irradiating a scattered light to the layer (A) imagewisely,
(III) developing the layer (A) by removing the portion to which the scattered light is imagewisely irradiated to form a pattern, and
(IV) calcinating the formed pattern to remove an unnecessary portion from the pattern formed in the step (III) to form a phosphor pattern, a phosphor pattern produced by the above process and a back plate for the plasma display panel provided with the phosphor pattern on a substrate for a plasma display panel.

25 Claims, 5 Drawing Sheets

FIG. 3(III)
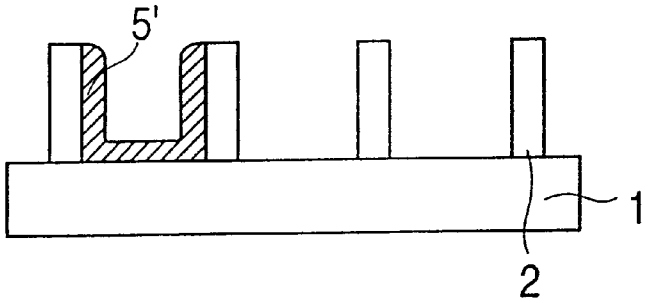

PROCESS FOR PREPARING PHOSPHOR PATTERN, PHOSPHOR PATTERN PREPARED THE SAME AND BACK PLATE FOR PLASMA DISPLAY PANEL

BACKGROUND OF THE INVENTION

This invention relates to processes for preparing a phosphor pattern, the phosphor pattern prepared by the same and a back plate for a plasma display panel.

In the prior art, as one of flat plate displays, there has been known a plasma display panel (hereinafter referred to as "PDP") which enables multicolor display by providing a phosphor which emits light by plasma discharge.

In PDP, flat front plate and back plate comprising glass are arranged in parallel with each other and facing to each other, both of the plates are retained at a certain interval by a barrier rib provided therebetween, and PDP has a structure that discharge is effected in a space surrounded with the front plate, the back plate and the barrier rib.

In such a space, a phosphor is coated for display, and by discharge, the phosphor emits light by UV ray generated from filler gas, and the light can be recognized by an observer.

In the prior art, as a method for providing the phosphor, a method of coating a slurry solution or paste in which phosphors of the respective colors are dispersed, by a printing method such as screen printing has been proposed and disclosed in Japanese Provisional Patent Publications No. 115027/1989, No. 124929/1989, No. 124930/1989 and No. 155142/1990.

However, the above phosphor-dispersed slurry solution is liquid so that dispersion failure due to precipitation of the phosphors occurs easily, and the slurry solution also has a drawback that when a liquid photosensitive resist is used in the slurry solution, storage stability is poor due to acceleration of a dark reaction or the like. Further, the printing method such as screen printing is inferior in printing precision so that there are problems that it is difficult to cope with enlargement of a screen of PDP in the future, and others.

In order to solve these problems, there has been proposed a method of using a photosensitive element (which is also called as a photosensitive film) containing a phosphor (Japanese Provisional Patent Publication No. 273925/1994).

In the method of using a photosensitive element, only a phosphor-containing photosensitive resin layer of a photosensitive element comprising a photosensitive resin layer containing a phosphor and a support film is embedded in the space of the above substrate for PDP by contact bonding (lamination) under heating, the layer is subjected to imagewise exposure with active light such as UV ray by a photographic method using a negative film, an unexposed portion is removed by a developing solution such as an alkaline aqueous solution, and further unnecessary organic components are removed by calcination to form a phosphor pattern only at a necessary portion.

In the method using such a photosensitive element, the photographic method is used so that a phosphor pattern can be formed with good precision.

However, when a phosphor-containing photosensitive resin layer is formed on the above-mentioned substrate for PDP by using the photosensitive element, then imagewisely exposing active light through a photomask, and subjecting to development and calcination according to the conventional method, it is difficult to form a phosphor pattern with uniform thickness and shape over the surface of a concave portion surrounded by the wall surface of a barrier rib and the bottom of the space since the photocurability at the wall surface portion of the barrier rib which is inside surface of the concave portion which space becomes a discharging space is lower than that of the bottom of the substrate so that the photosensitive resin layer containing the phosphor at the wall portion of the barrier rib is liable to be eroded at development.

SUMMARY OF THE INVENTION

The present invention is to provide a process for preparing a phosphor pattern, in which a phosphor pattern can be formed in a space of a substrate having unevenness such as a substrate for PDP on the whole inner surface of the concave portion with good yield, uniform film thickness with good flexibility.

The present invention is further to provide a process for preparing a phosphor pattern which is more excellent in simplicity and easiness, more excellent in pattern precision, operatability, more excellent in process flexibility, productivity, and excellent in suppressing decrease of a film thickness in addition to the effects as mentioned above.

The present invention is to provide a phosphor pattern which is high precision, uniform shape and excellent in luminance.

The present invention is to provide a back plate for a plasma display panel provided with a phosphor pattern which is high precision, uniform shape and excellent in luminance.

A process for preparing a phosphor pattern of the present invention comprises the steps of (I) forming a phosphor-containing photosensitive resin composition layer (A) on a substrate having unevenness, (II) irradiating a scattered light to the phosphor-containing photosensitive resin composition layer (A) imagewisely, (III) developing the phosphor-containing photosensitive resin composition layer (A) by removing the portion to which the scattered light is imagewisely irradiated to form a pattern, and (IV) calcinating the formed pattern to remove an unnecessary portion from the pattern formed in the step (III) to form a phosphor pattern.

In the present invention, the above step (I) preferably I comprises a step of laminating a photosensitive element which has the phosphor-containing photosensitive resin composition layer (A) having a support so as to oppose the substrate having unevenness to the photosensitive resin composition layer (A) of the photosensitive element.

The above step (II) preferably comprises (IIa) irradiating active light to the phosphor-containing photosensitive resin composition layer (A) through a photomask provided on the photosensitive resin composition layer and a sheet having a light scattering function provided on the photomask.

Also, the above step (II) preferably comprises (IIb) irradiating active light to the phosphor-containing photosensitive resin composition layer (A) through a sheet having a light scattering function provided on the photosensitive resin composition layer and a photomask provided on the sheet.

Also, the above step (II) preferably comprises (IIc) irradiating active light to the phosphor-containing photosensitive resin composition layer (A) through a photomask in which the light transmission portion has a light scattering function provided on the photosensitive resin composition layer.

In the present invention, the width of the photomask at the light transmission portion is narrower than that of an opening at the concave portion of the substrate.

The present invention also relates to the phosphor pattern which comprises repeating the above steps (I) to (III) to form a multi-colored pattern comprising photosensitive resin composition layers containing phosphors which form colors of red, green and blue, and then subjecting the above step (IV) to form a multi-colored phosphor pattern.

The present invention further relates to the phosphor pattern which comprises repeating the above steps (I) to (IV) to form a multi-colored phosphor pattern which forms colors of red, green and blue.

The present invention further relates to the process mentioned above, wherein the phosphor-containing photosensitive resin composition layer (A) contains:

(a) a "film property-imparting polymer", (b) a photopolymerizable unsaturated compound having an ethylenically unsaturated group, (c) a photopolymerization initiator which forms free radical by irradiation of the active light, and (d) a phosphor.

The present invention further relates to the phosphor pattern produced by the above-mentioned processes for preparing the phosphor pattern.

The present invention further relates to a back plate for the plasma display panel provided with the above-mentioned phosphor patterns on the substrate for plasma display panel.

DESCRIPTION OF THE PREFERRED EMBODIMENTS

In the following, the present invention is explained in detail.

A process for preparing a phosphor pattern of the present invention comprises the steps of (I) forming a phosphor-containing photosensitive resin composition layer (A) on a substrate having unevenness, (II) irradiating a scattered light to the phosphor-containing photosensitive resin composition layer (A) imagewisely, (III) developing the phosphor-containing photosensitive resin composition layer (A) by removing the portion to which the scattered light is imagewisely irradiated to form a pattern, and (IV) calcinating the formed pattern to remove an unnecessary portion from the pattern formed in the step (III) to form a phosphor pattern.

As the substrate having unevenness in the present invention, there may be mentioned, for example, a substrate for a plasma display panel (a substrate for PDP) on which a barrier rib is formed.

As the substrate for PDP, there may be mentioned, for example, a substrate such as a glass plate and a synthetic resin plate, which may be subjected to surface treatment for transparent adhesion and on which an electrode and a barrier rib are formed.

Formation of a barrier rib is not particularly limited, and a known material may be used. For example, a rib material containing silica, a binder such as a thermoplastic resin and a thermosetting resin, a low melting point glass (e.g., lead oxide) and a solvent may be used.

On the substrate for PDP, in addition to an electrode and a barrier rib, a dielectric film, an insulating film, an auxiliary electrode and a resistor may be formed, if necessary.

A method for forming the above members on the substrate is not particularly limited. For example, an electrode can be formed on the substrate by a method such as vapor deposition, sputtering, plating, coating and printing, and a barrier rib can be formed on the substrate by a method such as a printing method, a sand blasting method and an embedding method.

Figure 1:
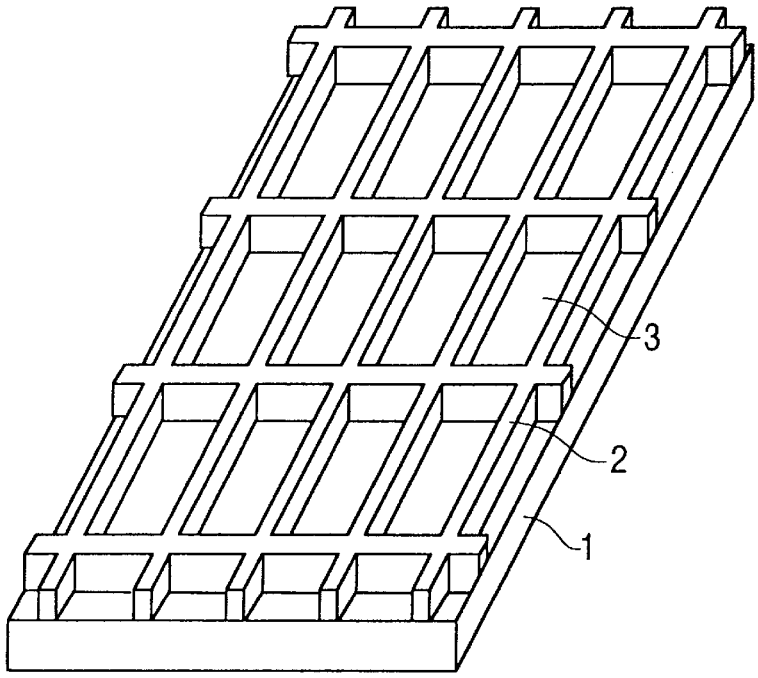
FIG. 1 is a schematic view showing one embodiment of a substrate for PDP on which a barrier rib is formed.
Figure 2:
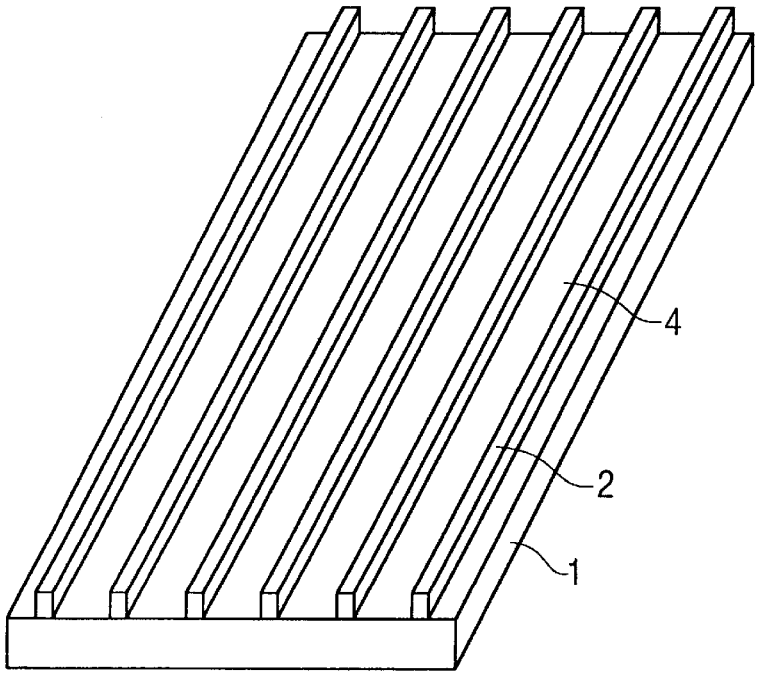
FIG. 2 is a schematic view showing one embodiment of a substrate for PDP on which a barrier rib is formed.

FIG. 1 and FIG. 2 each show a schematical view of one embodiment of the substrate for PDP on which a barrier rib is formed.

The barrier rib generally has a height of 20 to 500 $\mu$m and a width of 20 to 200 $\mu$m.

The shape of a discharge space surrounded by the barrier rib is not particularly limited and may be lattice-shaped, striped, honeycomb-shaped, triangular or elliptical. In general, a lattice-shaped or striped discharge space as shown in FIG. 1 or FIG. 2 is formed.

In FIG. 1 and FIG. 2, a barrier rib 2 is formed on a substrate 1. In FIG. 1, a lattice-shaped discharge space 3 is formed, and in FIG. 2, a striped discharge space 4 is formed.

The size of the discharge space is determined by the size and resolution of PDP. In general, in the lattice-shaped discharge space as shown in FIG. 1, the longitudinal and lateral lengths are 50 $\mu$m to 1 mm, and in the striped discharge space as shown in FIG. 2, the interval is 30 $\mu$m to 1 mm.

The composition of the phosphor-containing photosensitive resin composition layer (A) of the present invention is not particularly limited and can be constituted by using a photosensitive resin composition usually employed in the photolithography method, but in the points of photosensitivity and operatability or workability, it is preferably contain (a) a film property-imparting polymer, (b) a photopolymerizable unsaturated compound having an ethylenically unsaturated group, (c) a photopolymerization initiator which forms free radical by irradiation of the active light, and (d) a phosphor.

Also, the phosphor-containing photosensitive resin composition layer (A) of the present invention preferably contains, as (b) the photopolymerizable unsaturated compound having an ethylenically unsaturated group, polyethylene glycol di(meth)acryalte, polypropylene glycol di(meth)acrylate, poly(ethylene-propylene)glycol di(meth) acrylate which have good thermal decomposition property since an unnecessary portion shall be removed by calcination when preparing a phosphor pattern.

For preparing a phosphor pattern mentioned below, it is necessary to remove an unnecessary portion by calcination. Thus, among components of the photosensitive resin composition constituting (A) the photosensitive resin composition layer of the present invention, these components other than (d) the phosphor and a binder which is mentioned below and used depending on necessity preferably have good thermal decomposition property. Accordingly, any components other than (d) the phosphor and the binder constituting the photosensitive resin composition preferably do not contain any elements other than carbon, hydrogen, oxygen and nitrogen as a constitutional element.

The formulation amount of Component (a) in the present invention is preferably 10 to 90 parts by weight, more preferably 20 to 80 parts by weight based on the total amount of Component (a) and Component (b) as 100 parts by W weight. If the formulation amount is less than 10 parts by weight, when the resulting material is supplied as a photosensitive element in a roll state, a phosphor-containing photosensitive resin is exuded from a roll edge portion (hereinafter referred to as "edge fusion") so that it is difficult to carry out drawing from a roll at the time of lamination of a photosensitive element, and an exuded portion is partially and excessively embedded in the space of the substrate for PDP, whereby a problem of significant lowering of production yield is caused or film-forming property tends to be lowered. If the formulation amount exceeds 90 parts by weight, sensitivity tends to be insufficient.

The formulation amount of Component (b) in the present invention is preferably 10 to 90 parts by weight, more preferably 20 to 80 parts by weight based on the total amount of Component (a) and Component (b) as 100 parts by weight. If the formulation amount is less than 10 parts by weight, the sensitivity of a phosphor-containing photosensitive resin composition tends to be insufficient. If the formulation amount exceeds 90 parts by weight, a photocured product tends to be brittle, and when a photosensitive element is prepared, a phosphor-containing photosensitive resin composition tends to be exuded from an edge portion by flowing, or film-forming property tends to be lowered.

The formulation amount of Component (c) in the present invention is preferably 0.01 to 30 parts by weight, more preferably 0.1 to 20 parts by weight based on the total amount of Component (a) and Component (b) as 100 parts by weight. If the formulation amount is less than 0.01 part by weight, the sensitivity of a phosphor-containing photosensitive resin composition tends to be insufficient. If the formulation amount exceeds 30 parts by weight, photocuring of an inner portion tends to be insufficient due to increase in absorption of active light at an exposed surface of a phosphor-containing photosensitive resin composition.

The formulation amount of Component (d) in the present invention is preferably 10 to 400 parts by weight, more preferably 50 to 350 parts by weight, particularly preferably 70 to 300 parts by weight based on the total amount of Component (a), Component (b) and Component (c) as 100 parts by weight. If the formulation amount is less than 10 parts by weight, when light is emitted as PDP, light emission efficiency tends to be lowered. If the formulation amount exceeds 400 parts by weight, when a photosensitive element is prepared, film-forming property tends to be lowered, or flexibility tends to be lowered.

To the photosensitive resin composition constituting the phosphor-containing photosensensitive resin composition layer (A) of the present invention, a plasticizer may be added to improve film property.

As the plasticizer, examples thereof may include a polyalkylene glycol such as a polypropylene glycol represented by the following formula (I):

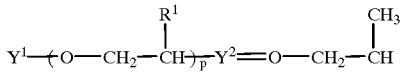

wherein $R^1$ represents a hydrogen atom or a methyl group, $Y^1$ represents a hydrogen atom, a saturated hydrocarbon group which may have a substituent or a polyalkylene glycol residue, $Y^2$ represents a hydroxyl group, a saturated hydrocarbon group which may have a substituent or a polyalkylene glycol residue, and p represents an integer of 1 to 100, provided that $R^1$ is a hydrogen atom, at least one of $Y^1$ and $Y^2$ represents a polypropylene glycol residue, and a derivative thereof, and a polyethylene glycol and a derivative thereof; and dioctylphthalate, diheptylphthalate, dibutylphthalate, tricresylphosphate, cresyldiphenylphosphate, and biphenyldiphenylphosphate.

When the plasticizer is formulated, its formulation amount is preferably 0.01 to 90 parts by weight, more preferably 0.01 to 80 parts by weight, particularly preferably 0.01 to 70 parts by weight based on the total amount of Component (a) and Component (b) as 100 parts by weight. If the formulation amount exceeds 90 parts by weight, the sensitivity of a phosphor-containing photosensitive resin composition tends to be insufficient.

To the photosensitive resin composition constituting the phosphor-containing photosensitive resin composition layer (A) of the present invention, a compound having a carboxyl group may be added to improve storage stability without causing increase in viscosity for a long period of time.

The compound having a carboxyl group may include, for example, a saturated aliphatic acid, an unsaturated aliphatic acid, an aliphatic dibasic acid, an aromatic dibasic acid, an aliphatic tribasic acid, an aromatic tribasic acid, and the like.

When the compound having a carboxyl group is formulated, its formulation amount is preferably 0.01 to 30 parts by weight based on the amount of Component (a) as 100 parts by weight. If the formulation amount is less than 0.01 part by weight, the storage stability tends to be low, while if it exceeds 30 parts by weight, the sensitivity of a phosphor-containing photosensitive resin composition tends to be insufficient.

To the photosensitive resin composition constituting the phosphor-containing photosensitive resin composition layer (A) of the present invention, a dispersant is preferably added to improve dispersibility of the phosphor.

Examples of the dispersant may include inorganic dispersants (silica gel type, bentonite type, kaolinite type, talc type, hectorite type, montmolironite type, saponite type, beidellite type dispersants), organic dispersants (aliphatic amide type, aliphatic ester type, polyethylene oxide type, sulfate type anionic surfactant, polycarboxylic acid amine salt type, polycarboxylic acid type, polyamide type, high molecular weight polyether type, acryl copolymer type, specific silicone type dispersants) and the like.

These dispersants may be used alone or in combination of two or more.

When the dispersant is formulated, its formulation amount is preferably 0.01 to 100 parts by weight based on the amount of Component (a) as 100 parts by weight. If the formulation amount is less than 0.01 part by weight, the added effect tend to be not revealed, while if it exceeds 100 parts by weight, the pattern formation precision (a property of obtaining a pattern comprising the photosensitive resin composition layer containing a phosphor with precise dimension and desired shape after development) tends to be lowered.

To the photosensitive resin composition constituting the phosphor-containing photosensitive resin composition layer (A) of the present invention, a binder is preferably added to prevent peel off of the phosphor from the PDP barrier rib substrate after calcination.

Examples of the binder may include, for example, a low-melting point glass, a metal alkoxide, a silane coupling agent and the like. These binders may be used alone or in combination of two or more.

When the binder is formulated, its formulation amount is not particularly limited and preferably 0.01 to 100 parts by weight, more preferably 0.05 to 50 parts by weight, particularly preferably 0.1 to 30 parts by weight based on the amount of Component (d) as 100 parts by weight. If the formulation amount is less than 0.01 part by weight, the binding effect tend to be not revealed, while if it exceeds 100 parts by weight, emission efficiency tends to be lowered.

To the photosensitive resin composition constituting the phosphor-containing photosensitive resin composition layer (A) of the present invention, a dye, a color forming agent, a plasticizer, a pigment, a polymerization inhibitor, a surface modifier, a tackifier, a heat curing agent, etc. may be added depending on necessity.

In the following, respective steps of the preparation process of the phosphor pattern of the present invention are explained in detail.

(I) Step of forming a phosphor-containing photosensitive resin composition layer (A) on a substrate having unevenness The method for forming the phosphor-containing photosensitive resin composition layer (A) on a substrate having unevenness is not specifically limited, and, for example, it can be carried out by the method in which respective components constituting the phosphor-containing photosensitive resin composition layer (A) is dissolved in or mixed with a solvent which can dissolve or disperse the components to form a uniform solution or dispersion, then the solution or dispersion is directly coated on the substrate having unevenness and dried to form the layer, or the method in which it is formed on the substrate having unevenness by using a photosensitive element having the phosphor-containing photosensitive resin composition layer (A) or the like. Among these, the method of forming the pattern by using a photosensitive element having the phosphor-containing photosensitive resin composition layer (A) on the substrate having unevenness is preferred since the method allows to form a phosphor pattern with uniform thickness and flexibility.

The photosensitive element to be used in the method of forming the pattern by using a photosensitive element having the phosphor-containing photosensitive resin composition layer (A) on the substrate having unevenness can be obtained by dissolving the respective components constituting the phosphor-containing photosensitive resin composition layer (A) or mixing the same with a solvent which can dissolve the components or disperse the same to form a uniform solution or dispersion, then coating the solution or dispersion directly on a substrate film such as polyethylene terephthalate, etc. by the conventionally known method and drying the same.

As the method of forming the pattern by using a photosensitive element having the phosphor-containing photosensitive resin composition layer (A) on the substrate having unevenness, there may be mentioned, for example, the method in which the phosphor-containing photosensitive resin composition layer (A) of the photosensitive element is laminated on the substrate having unevenness, embedding the same by heating or pressing to form the phosphor-containing photosensitive resin composition layer (A) on the inner surface of the concave portion, the method in which the phosphor-containing photosensitive resin composition layer (A) is embedded in the concave portion by heating or pressing using an embedding layer to form the phosphor-containing photosensitive resin composition layer (A) on the inner surface of the concave portion, or the like.

As the method of forming a pattern by laminating the phosphor-containing photosensitive resin composition layer (A) of the photosensitive element on the substrate having unevenness, embedding the same by heating or pressing on the inner surface of the concave portion, there may be mentioned, for example, when a cover film exist in the photosensitive element, after removing the cover film, the phosphor-containing photosensitive resin composition layer (A) is placed on the substrate having unevenness so as to contact with the same, and contact bonding the same under heating, or the like.

At this time, operations of the above contact bonding and contact bonding under heating may be carried out under a reduced pressure of $5\times10^4$ Pa or less.

Also, by using an embedding layer, the embedding layer is deformed by giving an energy such as heat, pressure and the like, and the phosphor-containing photosensitive resin composition layer (A) is embedded inside the concave portion of the substrate having unevenness by utilizing deformation of the embedding layer to form the phosphor-containing photosensitive resin composition layer (A) on the inner surface of the concave portion. As the method, there may be mentioned, for example, the method in which the phosphor-containing photosensitive resin composition layer (A) derived from the above-mentioned photosensitive element is provided on the substrate having unevenness, and an embedding layer such as the thermoplastic resin layer (B) is subjected to contact bonding under heating under the state that the embedding layer is provided on the phosphor-containing photosensitive resin composition layer (A), or the like.

A resin constituting the thermoplastic resin layer (B) is not particularly limited so long as it is softened at temperature at the time of contact bonding under heating, and there may be mentioned, for example, polyethylene, polypropylene, polyvinyl chloride, polyvinyl acetate, polyvinylidene chloride, polystyrene, polyvinyltoluene, polyacrylate, polymethacrylate, a copolymer of ethylene and vinyl acetate, a copolymer of ethylene and acrylate, a copolymer of vinyl chloride and vinyl acetate, a copolymer of styrene and acrylate or methacrylate, a copolymer of vinyltoluene and acrylate or methacrylate, a polyvinyl alcohol type resin (e.g., a hydrolyzate of polyacrylate or polymethacrylate, a hydrolyzate of polyvinyl acetate, a hydrolyzate of a copolymer of ethylene and vinyl acetate, a hydrolyzate of a copolymer of ethylene and acrylate, a hydrolyzate of a copolymer of vinyl chloride and vinyl acetate, a hydrolyzate of a copolymer of styrene and acrylate or methacrylate, a hydrolyzate of a copolymer of vinyltoluene and acrylate or methacrylate, etc.), a water-soluble salt of carboxyalkyl cellulose, water-soluble cellulose ethers, a water-soluble salt of carboxyalkyl starch, polyvinyl pyrrolidone and a resin having a carboxyl group obtained by copolymerizing an unsaturated carboxylic acid and an unsaturated monomer which is copolymerizable therewith.

In the thermoplastic resin layer (B) of the present invention, for the purpose of suppressing migration to the thermoplastic resin layer (B), there may be added depending on necessity a photopolymerizable unsaturated compound having an ethylenically unsaturated group, a photoinitiator forming free radicals by irradiation of active light, a compound having a carboxyl group, a dye, a color forming agent, a plasticizer, a polymerization inhibitor, a surface modifier, a stabilizer, a tackifier and a heat curing agent. As these materials, those which can be used in the photosensitive resin composition constituting the phosphor-containing photosensitive resin composition layer (A) as mentioned above may be used.

Among the materials as mentioned above, for example, as for polyethylene, polypropylene, polyamide, etc., those which are formed to a sheet state by a melt extrusion method may be used as an embedding layer.

As the method of providing the phosphor-containing photosensitive resin composition layer (A) derived from the above-mentioned photosensitive element on the substrate having unevenness, and contact bonding under heating an embedding layer such as the thermoplastic resin layer (B) under the state that the embedding layer is provided on the phosphor-containing photosensitive resin composition layer (A), there may be mentioned, for example, the method in which the above-mentioned photosensitive element is laminated on the substrate having unevenness, after removing a support film when the support film exist on the element, the thermoplastic resin layer (B) (after removing a cover film when the cover film exist on the layer) is provided on the phosphor-containing photosensitive resin composition layer (A), and the laminate is subjected to contact bonding under heating by heating rolls.

At this time, operations of the above contact bonding and contact bonding under heating may be carried out under a reduced pressure of $5\times10^4$ Pa or less.

Also, in the step (I) of the present invention, when the embedding layer such as the thermoplastic resin layer (B) and the photosensitive element having the phosphor-containing photosensitive resin composition layer (A) are used, it may be carried out to laminate the phosphor-containing photosensitive resin composition layer (A) and the thermoplastic resin layer (B) (these layer (A) and layer (B) are separately supplied) so that the phosphor-containing photosensitive resin composition layer (A) is in contact with the surface of the substrate having unevenness by subjecting these two layers simultaneously to contact bonding under heating.

In the step (I) of the present invention, a photosensitive element in which an embedding layer such as the thermoplastic resin layer (B) and the phosphor-containing photosensitive resin composition layer (A) are integrated is laminated on the substrate having unevenness so as to contact the phosphor-containing photosensitive resin composition layer (A) to the substrate, and subjected these two layers simultaneously to contact bonding under heating.

Figure 3I:
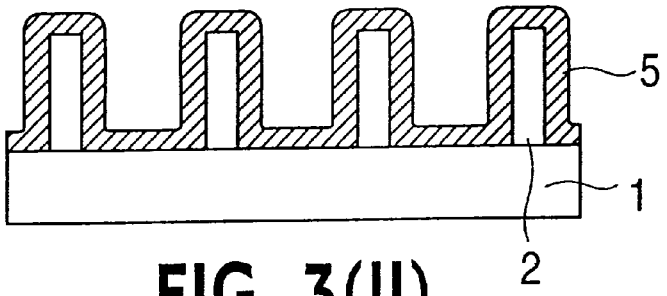
FIGS. 3(I)–3(IV) are schematic views showing one embodiment of the respective steps of the process for preparing a phosphor pattern according to the present invention.
Figure 3:
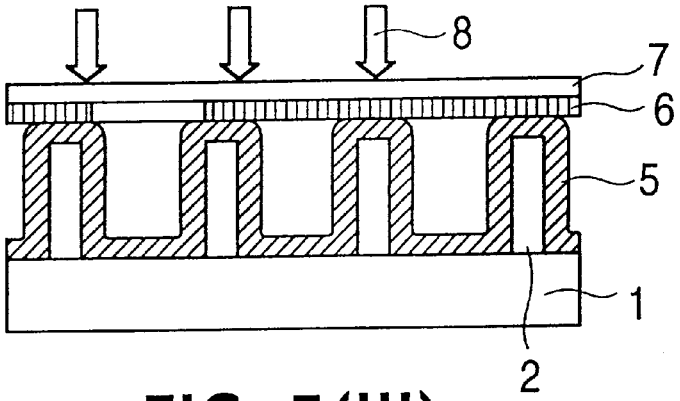
Figure 3:
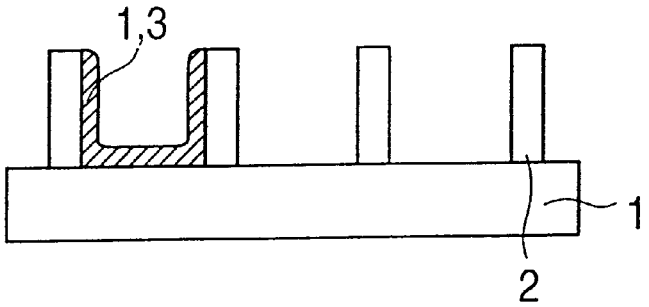

In the following, the preparation process of the phosphor pattern of the present invention is described in detail by referring to FIG. 3. FIG. 3 is a schematic view showing one example of the respective steps of a process for preparing the phosphor pattern of the present invention.

In FIG. 3 (I), the state of forming the phosphor-containing photosensitive resin composition layer (A) 5 on a substrate 1 (a substrate having unevenness) for a PDP to which a barrier rib 2 is formed.

In the step (I) of the present invention, when an embedding layer is used, an embedding layer exist on the phosphor-containing photosensitive resin composition layer (A) 5 in FIG. 3 (I).

(II) A step of irradiating a scattered light to the phosphor-containing photosensitive resin composition layer (A) imagewisely As embodiments of the step (II), there may be mentioned, for example, (IIa) a step of irradiating active light to the phosphor-containing photosensitive resin composition layer (A) through a photomask provided on the photosensitive resin composition layer and a sheet having a light scattering function provided on the photomask, (IIb) a step of irradiating active light to the phosphor-containing photosensitive resin composition layer (A) through a sheet having a light scattering function provided on the photosensitive resin composition layer and a photomask provided on the sheet, and (IIc) a step of irradiating active light to the phosphor-containing photosensitive resin composition layer (A) through a photomask in which the light transmission portion has a light scattering function provided on the photosensitive resin composition layer.

In the following, (IIa) the step of irradiating active light to the phosphor-containing photosensitive resin composition layer (A) through a photomask provided on the photosensitive resin composition layer and a sheet having a light scattering function provided on the photomask which is one embodiment of the step (II) is explained. This step (IIa) is shown in FIG. 3 (II).

Figure 4:
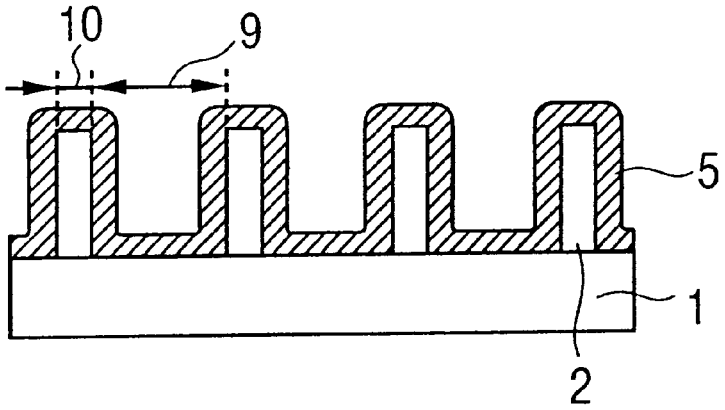
FIG. 4 is a schematic view showing the width of the barrier rib of the present invention and the width of an opening at the concave portion.
Figure 5:
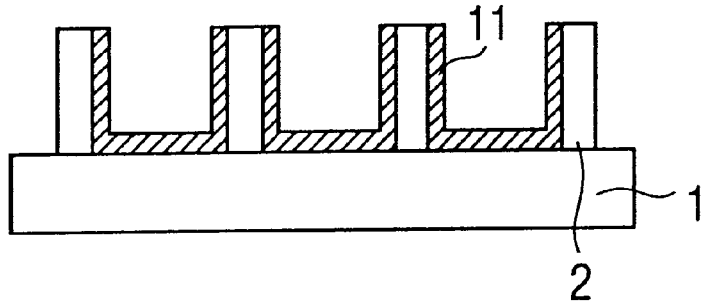
FIG. 5 is a schematic view showing an inner surface at the concave portion to be photocured.

Here, as a photomask, that in which the width of the light transmission portion is narrower than that of an opening at the concave portion of the substrate can be used. An opening portion 9 of the concave portion and the width 10 of the barrier rib of the present invention are shown in FIG. 4. FIG. 5 is a schematic view showing an inner surface of the concave portion, and in FIG. 5, the inner surface of the concave portion 11 are shaded.

The width of the above light transmission portion is preferably from a width in which the widths 10 of the barrier ribs at the both sides of the opening are added to the width 9 of the opening of the concave portion (when the width 10 of the barrier rib is 70 $\mu$m, it is a width of 140 $\mu$m wider than the width 9 of the opening of the concave portion) to a width of 120 $\mu$m narrower than the width 9 of the opening of the concave portion, more preferably a width in which 50% of the width 10 of the barrier ribs at the both sides of the opening are added to the width 9 of the opening of the concave portion (when the widths 10 of the barrier rib is 70 $\mu$m, it is a width of 70 $\mu$m wider than the width 9 of the opening of the concave portion) to a width of 90 $\mu$m narrower than the width 9 of the opening of the concave portion, particularly preferably a width of 1 $\mu$m to 60 $\mu$m narrower than the width 9 of the opening of the concave portion.

When the width at the light transmission portion is wider than the width in which the width 10 of the barrier ribs at the both sides of the opening are added to the width 9 of the opening of the concave portion, a portion other than the inner surface of the concave portion to be photocured tends to be photocured so that unnecessary portion tends to be remained after development as mentioned below. Also, when it is narrower than a width in which 120 $\mu$m is subtracted from the width 9 of the opening of the concave portion, photocuring of the phosphor-containing photosensitive resin composition layer (A) 5 formed on the inner surface of the concave portion tends to be insufficient. Also, in the development step mentioned below, development resistance (a property that a portion which is to be remained without removing by the development is not eroded by the developing solution) of the phosphor-containing photosensitive resin composition layer (A) 5 formed on the inner surface of the concave portion tends to be lowered, and the necessary portion of the phosphor-containing photosensitive resin composition layer (A) 5 formed on the inner surface of the concave portion tends to be removed.

Here, active light transmission width of the width 9 of the opening at the concave portion represents active light transmission width at the width 9 of the opening at the concave portion of 150 μm and the width 10 of the barrier rib of 70 μm. Accordingly, when the dimension of the width 9 of the opening at the concave portion fluctuates, a narrower range of the active light transmission width than the above width 9 of the opening at the concave portion is determined depending on the fluctuation ratio.

The sheet 7 having a light scattering function of the present invention can be any material so long as it is possible to refract or scatter light.

In the present invention, by irradiating active light through the photomask 6 and the sheet having a light scattering function, only (A) the photosensitive resin composition layer 5 containing a phosphor formed on the inner surface of the concave portion can be selectively photocured with high reactivity at both of the barrier rib wall portion and the substrate bottom portion which are inner surfaces of the concave portion. Also, the position of the sheet 7 having a light scattering function at use may be any position so long as it locates between the photomask 6 and the active light source. It may be used with a distance of 0.3 to 30 cm apart from the photomask 6 or may be used in contact with the photomask 6.

Examples of the sheet 7 having a light scattering function may include Quilting Meiler (trade name, available from ORC Seisakusho) and an exposure film having unevenness on the film surface, embossed film, film mat, sand mat film, bloomed glass, frosted glass, designed glass, a material in which a film or glass which transmits general-purpose active light is ground by a laser beam to make the surface uneven, a material in which glass is treated by hydrogen fluoride, etc. (respective glasses mentioned above mean a sheet or plate glass) to make the surface uneven, and a film containing fine particles to scatter light. These materials may be used alone or in combination of two or more. The sheet 7 having a light scattering function may be any materials wherein a material in which the light scattering function is provided only one surface thereof, a material in which the light scattering functions are provided to both surfaces, a material in which different light scattering functions are provided to the surface and the back surface, a material in which light scattering functions are provided to the inside and one surface thereof, a material in which the light scattering functions are provided to the inside and both surfaces, and a material in which different light scattering functions are provided to the inside and the surface and the back surface. As for the material in which the light scattering function is provided only one surface thereof and the material in which different light scattering functions are provided to the surface and the back surface, active light may be irradiated to either of the surfaces.

The surface roughness of the sheet 7 having a light scattering function in which the surface has been treated preferably has a surface roughness Ra (Arithmetical mean deviation roughness) of 0.1 μm or more, more preferably 0.15 μm or more, particularly preferably 0.2 μm or more. If the surface roughness Ra is less than 0.1 μm, light scattering does not take place sufficiently so that the phosphor-containing photosensitive resin composition layer (A) at the barrier rib side surface portion tends to be eroded. The surface roughness Ra of the sheet 7 having a light scattering function where the surface of which is treated can be measured by using a surface roughness measuring device, a non-contact type shape measuring device, etc. according to JIS B0601 (Definition and description of surface roughness) with a cut off value (Lc)=0.8 mm, and a measurement length=2.5 mm.

Specific measurement method may include, for example, the method in which one surface which is not a measured surface of a surface-treated sheet 7 having a light scattering function is adhered onto a glass plate having a surface roughness Ra=0.05 or less, and the surface roughnesses are measured at the center portions and the portions 5 mm and 10 mm distant from the center portion (up and down directions) of the by selecting at least 5 points of the surface-treated sheet 7 having a light scattering function, and an average value Ra is obtained from these values An amount of an alien substance contained in the sheet 7 having a light scattering function and containing alien substances therein is preferably 0.1 to 200% by volume, more preferably 1 to 150% by volume, particularly preferably 3 to 100% by volume based on the volume (100% by volume) of the sheet 7 having a light scattering function. If the amount of the alien substance contained in the sheet 7 having a light scattering function is less than 0.1% by volume, light scattering does not sufficiently occur so that the phosphor-containing photosensitive resin composition layer (A) at the barrier rib side surface portion tends to be eroded, while if it exceeds 200% by volume, the exposure time becomes relatively long and an operation efficiency tends to be lowered.

A transmittance of the sheet 7 having a light scattering function is preferably 1 to 100%, more preferably 3 to 100 %, more preferably 10 to 100%, further preferably 30 to 100%, most preferably 50 to 100% as compared with the case where no sheet having a light scattering function is used at the wavelength region of 230 nm to 450 nm. When the transmittance of the sheet 7 having a light scattering function is less than 1%, the exposure time becomes relatively long and an operation efficiency tends to be lowered. A thickness of the sheet 7 having a light scattering function may be any range so long as its transmittance is 1 to 100% as compared with the case where no sheet having a light scattering function is used at the wavelength region of 230 nm to 450 nm, but the thickness is usually 5 m to 1 cm.

The photomask to be used in the step (IIa) is not particularly limited and conventionally known materials can be used. For example, it may include a negative film, a negative glass, a positive film, and a positive glass, etc. Such a photomask is also used in the step (IIb).

The photomask having a light scattering function at the light transmitting portion to be used in the step (IIc) can be prepared by, for example, the method in which an opening portion of a photomask having no light scattering function at the light transmitting portion is treated by a laser or hydrogen fluoride, the method in which a surface of a photomask having no light scattering function at the light transmitting portion at which no light shielding portion is provided is polished by a sand paper, etc. to form uneven thereon, and the method in which a light shielding portion is provided to a sheet having a light scattering function by the conventionally known method, or the like.

The surface roughness of the photomask having a light scattering function in which the surface has been treated has preferably a surface roughness Ra (center line average roughness) of 0.1 μm or more, more preferably 0.15 μm or more, particularly preferably 0.2 μm or more. If the surface roughness Ra is less than 0.1 μm, light scattering does not take place sufficiently so that the phosphor-containing photosensitive resin composition layer (A) at the barrier rib side surface portion tends to be eroded.

An amount of an alien substance contained in the photomask having a light scattering function and containing alien substances therein is preferably 0.1 to 200% by volume, more preferably 1 to 150% by volume, particularly preferably 3 to 100% by volume based on the volume (100% by volume) of the photomask having a light scattering function. If the amount of the alien substance contained in the photomask having a light scattering function is less than 0.1% by volume, light scattering does not sufficiently occur so that the phosphor-containing photosensitive resin composition layer (A) at the barrier rib side surface portion tends to be eroded, while if it exceeds 200% by volume, the exposure time becomes relatively long and an operation efficiency tends to be lowered.

As the photomask in which light scatters at an opening portion of the present invention, those having a wider active light transmission width to a narrower active light transmission width than the width of the opening portion of the concave portion can be used.

At this time, when an embedding layer exists on the phosphor-containing photosensitive resin composition layer (A) 5, active light 8 can be imagewisely irradiated after removing the embedding layer by peeling off or development. When the embedding layer comprises a material which transmits the active light 8, the active light 8 can be imagewisely irradiated to the embedding layer through a photomask 6 and a sheet 7 having a light scattering function in the state of existing the embedding layer.

As the active light 8, a known active light source may be used, and there may be mentioned, for example, light generated from carbon arc, mercury vapor arc, xenon arc or light generated from the others and the like.

The irradiation dose of the active light 8 of the present invention is not particularly limited, and preferably 5 to 20,000 mJ/cm$^2$, more preferably 7 to 10,000 mJ/cm$^2$, particularly preferably 10 to 5,000 mJ/cm$^2$. If the irradiation dose of the active light 8 is less than 5 mJ/cm$^2$, photocuring of the phosphor-containing photosensitive resin composition layer (A) 5 formed on the inner surface of the concave portion tends to be insufficient. Also, in the development step mentioned below, development resistance (a property that a portion which is to be remained without removing by the development is not eroded by the developing solution) of the phosphor-containing photosensitive resin composition layer (A) 5 formed on the inner surface of the concave portion tends to be lowered. Also, when the irradiation dose of the active light 8 exceeds 20,000 mJ/cm$^2$, a portion other than the inner surface of the concave portion to be photocured tends to be photocured so that unnecessary portion tends to be remained after development as mentioned below.

Also, when carrying out the step (II), fine particles, etc. are spread on the phosphor-containing photosensitive resin composition layer (A), and active light can be imagewisely irradiated with the state that the light scattering effect is heightened.

(III) A step of developing the phosphor-containing photosensitive resin composition layer (A) by removing the portion to which the scattered light is imagewisely irradiated to form a pattern The state in which an unnecessary portion is removed by development is shown in FIG. 3 (III). In FIG. 3 (III), the reference numeral 51 is the phosphor-containing photosensitive resin composition layer (A) after photocuring.

In FIG. 3 (III), as the developing method, for example, after the state of FIG. 3 (II), when a support film exists on the phosphor-containing photosensitive resin composition layer (A), after removing it (when an embedding layer exists on the phosphor-containing photosensitive resin composition layer (A) 5, and a support film exists on the embedding layer, after removing it), development is carried out by the conventional method such as spraying, dipping under rocking, brushing, scraping, etc. by using the conventionally known developing solution such as an aqueous alkaline solution, an aqueous developing solution, an organic solvent, etc. to remove the unnecessary portion.

After development, to prevent deterioration of the phosphor, a base of the aqueous alkaline solution remained at the phosphor-containing photosensitive resin composition layer (A) 5' after photocuring can be treated by an acid (neutralization treatment) by using an organic acid, an inorganic acid or an aqueous solution of these acids according to the conventional method such as spraying, dipping under rocking, brushing, scraping, etc.

As the acid, there may be mentioned, for example, an organic acid such as a saturated aliphatic acid, an unsaturated aliphatic acid, an aliphatic dibasic acid, an aromatic dibasic acid, an aliphatic tribasic acid, an aromatic tribasic acid.

Thus, the phosphor-containing photosensitive resin composition layer (A) (unnecessary portion) formed on the portion other than the inner surface of the concave portion (when an embedding layer exists on the phosphor-containing photosensitive resin composition layer (A) 5, the embedding layer, or when the embedding layer has photosensitivity, the embedding layer other than the inner surface of the concave portion) is removed by development, and on the inner surface of the concave portion, the phosphor-containing photosensitive resin composition layer (A) 5' after photocuring (when the embedding layer having photosensitivity exists on the phosphor-containing photosensitive resin composition layer (A) 5, the embedding layer after photocuring is included) is formed.

Figure 6:
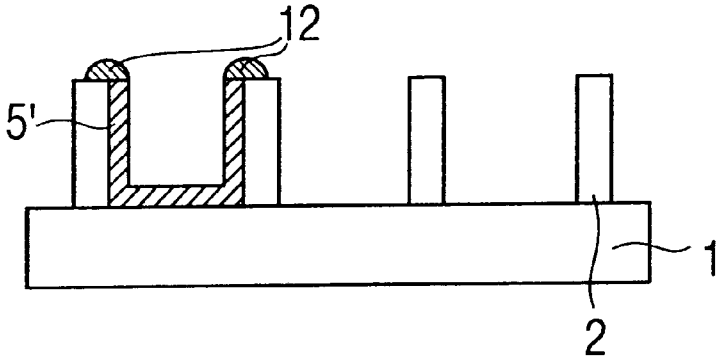
FIG. 6 is a schematic view showing the state after subjecting the step (III) when a photomask 6 having a broader opening width than the opening width of the concave portion in the step (II) of the present invention.

In the above-mentioned step (II), when a photomask 6 having a wider opening width than the opening width of the concave portion is used, the irradiated portion (when the embedding layer having photosensitivity exists on the phosphor-containing photosensitive resin composition layer (A) 5, the irradiated portion is included) of the phosphor-containing photosensitive resin composition layer (A) 5 formed at the portion other than the inner surface of the concave portion tends to become the state as shown in FIG. 6 by performing the present step (step (III)).

In this case, the phosphor-containing photosensitive resin composition layer (A) 5' (unnecessary portion) after curing remained at other than the inner surface of the concave portion (when the embedding layer having photosensitivity exists on the phosphor-containing photosensitive resin composition layer (A) 5, the embedding layer after photocuring is included) can be completely removed by polishing, etc.

FIG. 6 is a schematic view showing the state after conducting the step (III) when a photomask 6 which has a wider opening width than the opening width of the concave portion is used in the step (II) of the present invention. In FIG. 6, the reference numeral 12 is an unnecessary portion (a portion which should be completely removed by polishing, etc.).

Also, in place of the above-mentioned polishing, only the unnecessary portion can be physically removed by adhering an adhesive tape to the above-mentioned unnecessary portion and peeling off the tape.

After development, to improve adhesiveness and chemical resistance of the phosphor-containing photoresist at the inner surface of the concave portion of the substrate for PDP, UV-ray irradiation by a high pressure mercury lamp or heating with a dryer may be carried out.

(IV) A step of calcinating the formed pattern to remove an unnecessary portion from the pattern formed in the step (III) to form a phosphor pattern.

In FIG. 3 (IV), the state of forming a phosphor pattern after removing the unnecessary portion by calcination is shown. In FIG. 3 (IV), the reference numeral 13 is a phosphor pattern.

In FIG. 3 (IV), the calcination method is not particularly limited, and the phosphor pattern can be formed by using a conventionally known calcination method to remove the unnecessary portion other than the phosphor and binder.

The calcination temperature at this time is preferably 350 to 800° C., more preferably 400 to 600° C. Also, the calcination time is preferably 3 to 120 minutes, more preferably 5 to 90 minutes.

The temperature elevating rate at this time is preferably 0.5 to 50° C./min, more preferably 1 to 45° C./min. Also, between 350° C. and 450° C. which are before reaching to the maximum calcination temperature, a step of maintaining the temperature may be provided and the maintaining time is preferably 5 to 100 minutes.

In the process for preparing the phosphor pattern of the present invention, in the point of reducing the steps, it is preferred that the above-mentioned respective steps (I) to (III) are repeated for each color to form a multi-colored pattern comprising the photosensitive resin composition layers containing phosphors which form colors of red, green and blue, and then the step (IV) is performed to form a multi-colored phosphor pattern.

In the present invention, the phosphor-containing photosensitive resin composition layer (A) 5 which independently contains respective phosphors which form colors red, blue and green can be formed in any order with regard to the respective colors of red, blue and green.

Figure 7:
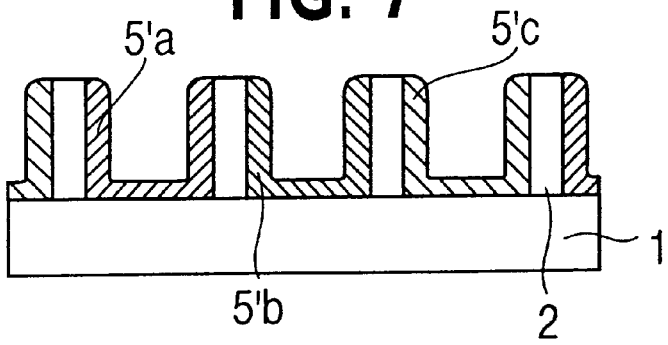
FIG. 7 is a schematic view showing the state of forming a multi-colored pattern comprising the photosensitive resin composition layer containing a phosphor.

In FIG. 7, the state in which a multi-colored pattern containing the phosphor-containing photosensitive resin composition layer which forms colors of red, green and blue is formed by repeating the respective steps of (I) to (III) for each color is shown. In FIG. 7, the reference numeral 5'*a* is a first color pattern, 5'*b* is a second color pattern, and 5'*c* is a third color pattern.

Figure 8:
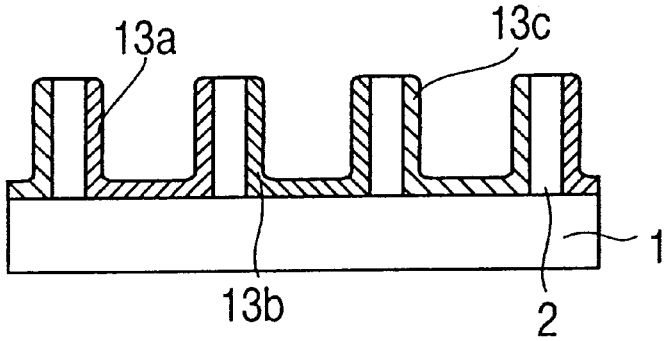
FIG. 8 is a schematic view showing the state of forming a multi-colored phosphor pattern.

Also, in FIG. 8, the state in which the step (IV) of the present invention is performed to form a multi-colored phosphor pattern is shown. In FIG. 8, the reference numeral 13*a* is a first phosphor pattern, 13*b* is a second phosphor pattern, and 13*c* is a third phosphor pattern.

Also, the process for preparing the phosphor pattern of the present invention is preferably carried out by repeating the respective steps (I) to (IV) as mentioned above for each color to form a multi-colored phosphor pattern in view of suppression of decrease in film thickness of the phosphor-containing photosensitive resin composition layer (A) 5 formed on the inner surface of the concave portion.

The phosphor pattern of the present invention preferably satisfies the relation of the layer thickness ratio x/y within the range of 0.1 to 1.5 in the points of luminance, a light utilization ratio, etc., more preferably within the range of 0.15 to 1.3, particularly preferably within the range of 0.2 to 1.2, when the height of the barrier rib is made L (μm), a film thickness x (μm) of the phosphor pattern formed at the position of 0.9×L of the barrier rib wall, and a film thickness y (μm) of the same formed at the position of 0.4×L of the barrier rib wall. If x/y is less than 0.1, apparent luminance by seeing from a wide-view angle tends to be lowered when it is emitted as PDP, while if it exceeds 1.5, a utilization ratio of visible light emitted from the phosphor is lowered and luminance tends to be lowered.

Also, when the phosphor is emitted as PDP, the layer thickness ratio x/y is preferably within the range of 0.1 to 0.5, more preferably 0.15 to 0.45, particularly preferably 0.2 to 0.4 in the point that a utilization ratio of visible light emitted from the phosphor can be increased.

Moreover, when the phosphor is emitted as PDP, the layer thickness ratio x/y is preferably within the range of 0.5 to 1.5, more preferably 0.55 to 1.3, particularly preferably 0.6 to 1.2 in the point that lowering in the apparent luminance by seeing from a wide-view angle can be suppressed.

The back plate for a plasma display panel of the present invention comprises providing phosphor pattern obtained as mentioned above on the substrate for a plasma display panel.

Figure 10:
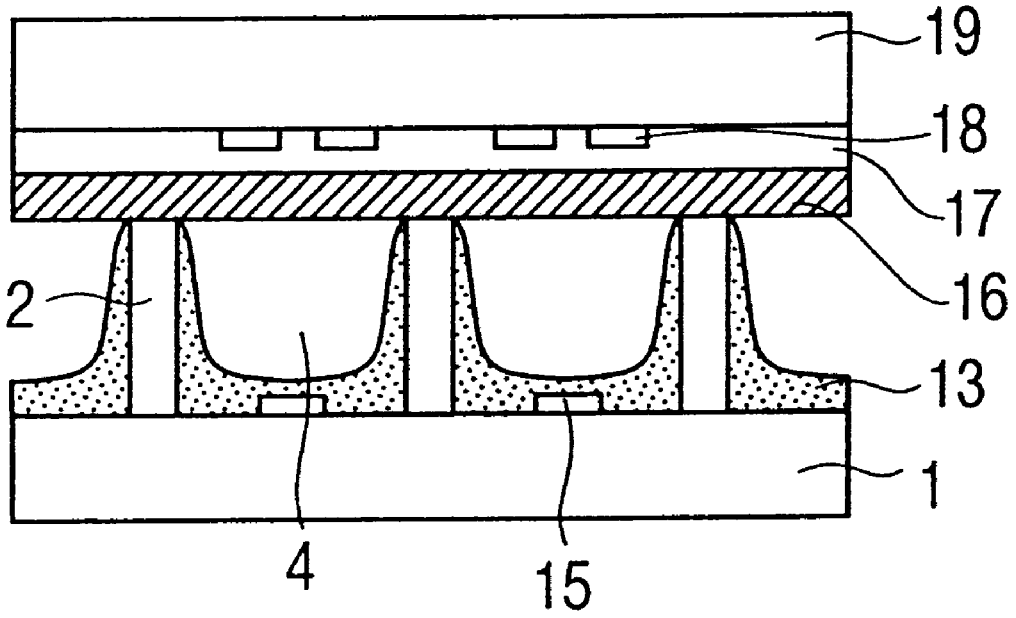
FIG. 10 is a schematic view showing one embodiment of a back plate for a plasma display panel of the present invention.

In the following, the back plate for a plasma display panel is explained by referring to FIG. 10. FIG. 10 is a schematic view showing one example of a plasma display panel (PDP), and in FIG. 10, the reference numeral 1 is a substrate, 2 is a barrier rib, 4 is a stripe shaped discharging space, 13 is a phosphor pattern, 14 is an electrode for address, 16 is a protective film, 17 is a dielectric layer, 18 is an electrode for display, and 19 is a substrate for a front plate.

In FIG. 10, the bottom portion containing the substrate 1, the barrier rib 2, the phosphor pattern 13 and the electrode for address 18 is a back plate for PDP, and the upper portion including the protective layer 16, the dielectric layer 17, the electrode for display 18 and the substrate for a front plate 19 is a front plate for PDP.

PDP can be classified into an AC (alternative current) type PDP and a DC (direct current) type PDP, and the schematic view shown in FIG. 10 as one example is the AC type PDP.

The process for preparing the phosphor pattern of the present invention can be also applied to self-emitting type display such as a field emission display (FED), an electroluminescence display (ELD), etc.

EXAMPLES

In the following, the present invention is explained by referring to Examples.

Preparation Example 1

(Preparation of Solution (a-1) of a polymer having film-forming property)

In a flask equipped with a stirrer, a reflux condenser, an inert gas inlet port and a thermometer were charged the materials ① shown in Table 1, and the mixture was elevated to 80° C. under nitrogen atmosphere, then, while maintaining the temperature at 80° C.±2° C., the material ② shown in Table 1 was added dropwise uniformly over 2 hours.

After completion of the materials ②, stirring was continued at 80° C.±2° C. for 6 hours to obtain a polymer solution (a-1) having film-forming property (solid component: 45.5% by weight) with a weight average molecular weight of 80,000 and an acid value of 130 mg KHO/g.

TABLE 1

| | Materials | Formulation amount |
|---|---|---|
| ① | Ethyleneglycol monomethyl ether | 70 parts by weight |
| | Toluene | 50 parts by weight |
| ② | Methacrylic acid | 20 parts by weight |
| | Methyl methacrylate | 55 parts by weight |
| | Ethyl acrylate | 15 parts by weight |
| | b-Butyl methacrylate | 10 parts by weight |
| | 2,2'-Azobis(isobutyronitrile) | 0.5 part by weight |

Preparation Example 2

(Preparation of Photosensitive element (A-1) having a phosphor-containing photosensitive resin composition layer (A))

The materials shown in Table 2 were mixed for 15 minutes by using a stirrer to obtain a solution for preparing a phosphor-containing photosensitive resin composition layer.

TABLE 2

| Materials | Formulation amount |
|---|---|
| Solution (a - 1) having film-forming property obtained in Preparation example 1 | 132 parts by weight (solid component: 60 parts by weight) |
| 4G (trade name, available from Shin-nakamura Kagaku Kogyo, Polyethylene-glycol dimethacrylate (average number of ethylene oxide: 4)) | 40 parts by weight |
| 2-Benzyl-2-dimethylamino-1-(4-morpholinophenyl)-butanone-1 | 3 parts by weight |
| $(Y,Gd)BO_3:Eu^{3+}$ | 140 parts by weight |
| Binder (low melting point glass) | 3 parts by weight |
| Methyl ethyl ketone | 30 parts by weight |

The resulting solution was uniformly coated on a polyethylene terephthalate film with a thickness of 20 μm, and dried by a hot-air convection drier at 80 to 110° C. for 10 minutes to remove the solvent and to form a phosphor-containing photosensitive resin composition layer (A). The thickness of the resulting phosphor-containing photosensitive resin composition layer (A) after drying was 60 μm.

Next, on the phosphor-containing photosensitive resin composition layer (A) was laminated a polyethylene film with a thickness of 25 μm as a cover film to prepare Photosensitive element (A-1) having the phosphor-containing photosensitive resin composition layer (A).

Preparation Example 3

(Preparation of Photosensitive element (A-2) having a phosphor-containing photosensitive resin composition layer (A))

In the same manner as in Preparation example 2 except for using the materials shown in Table 3 in place of the materials shown in Table 2, a phosphor-containing photosensitive resin composition layer (A) was prepared. The film thickness of the resulting phosphor-containing photosensitive resin composition layer (A) after drying was 60 μm.

TABLE 3

| Materials | Formulation amount |
|---|---|
| Solution (a - 1) having film-forming property obtained in Preparation example 1 | 132 parts by weight (solid component: 60 parts by weight) |

TABLE 3-continued

| Materials | Formulation amount |
|---|---|
| Polyethyleneglycol dimethacrylate (average number of propylene oxide: 12) | 40 parts by weight |
| 2-Benzyl-2-dimethylamino-1-(4-morpholinophenyl)-butanone-1 | 1 part by weight |
| $(Y,Gd)BO_3:Eu^{3+}$ | 140 parts by weight |
| Methyl ethyl ketone | 30 parts by weight |

Then, in the same manner as in Preparation example 2, Photosensitive element (A-2) having the phosphor-containing photosensitive resin composition layer (A) was prepared.

Preparation Example 4

(Preparation of Photosensitive element (A-3) having a phosphor-containing photosensitive resin composition layer (A))

In the same manner as in Preparation example 2 except for using the materials shown in Table 4 in place of the materials shown in Table 2, a phosphor-containing photosensitive resin composition layer (A) was prepared. The film thickness of the resulting phosphor-containing photosensitive resin composition layer (A) after drying was 60 μm.

TABLE 4

| Materials | Formulation amount |
|---|---|
| Poly(methyl methacrylate) (weight average molecular weight: about 70,000) | 60 parts by weight |
| Proethyleneglycol dimethacrylate (average number of ethylene oxide: 4) | 40 parts by weight |
| 2-Benzyl-2-dimethylamino-1-(4-morpholinophenyl)-butanone-1 | 1 part by weight |
| $(Y,Gd)BO_3:Eu^{3+}$ | 140 parts by weight |
| Methyl ethyl ketone | 30 parts by weight |

Then, in the same manner as in Preparation example 2, Photosensitive element (A-3) having the phosphor-containing photosensitive resin composition layer (A) was prepared.

Preparation Example 5

(Preparation of Film (B-1) containing an embedding layer (Thermoplastic resin layer (B)))

A resin solution comprising the materials shown in Table 5 was uniformly coated on a polyethylene terephthalate film having a thickness of 20 μm, and dried by a hot-air convection drier at 80 to 110° C. for 10 minutes to remove distilled water and to form a thermoplastic resin layer (B). The thickness of the resulting thermoplastic resin layer (B) after drying was 70 μm.

TABLE 5

| Materials | Formulation amount |
|---|---|
| Poly(vinyl alcohol) (available from Kurarey, PVA205, trade name, hydrolyzation degree = 80%) | 17.3 parts by weight |
| Distilled water | 28 parts by weight |

Then, on the thermoplastic resin layer (B) was laminated a polyethylene film having a thickness of 25 Mm as a cover film to prepare Film (B-1) having the thermoplastic resin layer (B).

Preparation Example 6

(Preparation of Film (B-2) containing an embedding layer (Thermoplastic resin layer (B)))

In the same manner as in Preparation example 5 except for using the materials shown in Table 6 in place of the materials shown in Table 5, a thermoplastic resin layer (B) was prepared. The film thickness of the resulting thermoplastic resin layer (B) after drying was 43 μm.

TABLE 6

| Materials | Formulation amount |
|---|---|
| Solution (a - 1) having film-forming property obtained in Preparation example 1 | 143 parts by weight (solid component: 65 parts by weight) |
| Triethylene glycol diacetate | 35 parts by weight |
| Methyl ethyl ketone | 30 parts by weight |

Then, in the same manner as in Preparation example 5, Film (B-2) having the thermoplastic resin layer (B) was prepared.

Preparation Example 7

(Preparation of Film (B-3) containing an embedding layer (Thermoplastic resin layer (B)))

In the same manner as in Preparation example 5 except for using the materials shown in Table 7 in place of the materials shown in Table 5, a thermoplastic resin layer (B) was prepared. The film thickness of the resulting thermoplastic resin layer (B) after drying was 50 μm.

TABLE 7

| Materials | Formulation amount |
|---|---|
| Poly(methyl methacrylate) (weight average molecular weight: about 70,000) | 70 parts by weight |
| Triethylene glycol diacetate | 30 parts by weight |
| Methyl ethyl ketone | 30 parts by weight |

Then, in the same manner as in Preparation example 5, Film (B-3) having the thermoplastic resin layer (B) was prepared.

(Preparation of phosphor pattern)

Example 1

<(I) Step of forming a phosphor-containing photosensitive resin composition layer (A) on a substrate having unevenness>

At a side on which a barrier rib (a striped barrier rib, opening width of barrier rib: 150 μm, width of barrier rib: 70 μm, height of barrier rib: 150 μm) was formed, of a substrate for PDP, Photosensitive element (A-1) having the phosphor-containing photosensitive resin composition layer (A) obtained in Preparation example 2 was placed while peeling off the polyethylene film, then, the polyethylene terephthalate film was peeled off and the material was placed in a vacuum drier under a vacuum degree of $1.3\times10^2$ Pa at a normal temperature.

Then, under reduced pressure, temperature of the material was raised to 90° C. with a rate of 5° C./min and maintained at 90° C. for 1 minute, and returned to an atmospheric pressure to give a pressure to form the phosphor-containing photosensitive resin composition layer (A) on the inner surface of the concave portion.

<(IIa) Step of irradiating active light to the phosphor-containing photosensitive resin composition layer (A) through a photomask provided on the photosensitive resin composition layer and a sheet having a light scattering function provided on the photomask>

Then, a photomask having an active light transmission width which is 15 μm narrower than the opening width of 150 μm between the barrier ribs was closely contacted onto the phosphor-containing photosensitive resin composition layer (A) so as to place the center of the active light transmission width of the photomask at the center of the opening width between barrier ribs and a sheet having a light scattering function (available from ORC Seisakusho, Quilting Meiler, trade name (which is produced by NIPPON CHEM-TECH CORP. with a trade name of EXPOSURE Film EWS-88, hereinafter the same), surface roughness Ra=3.65 μm, film thickness: 80 μm) was laminated thereon, and the laminated material was irradiated imagewisely by active light of 400 mJ/cm$^2$ using HMW-201GX type exposure machine (trade name, available from ORC Seisakusho).

The surface roughness Ra was measured by using a surface roughness measuring apparatus (Surfcoader SE-30D, trade name, available from Kosaka Kenkyusho) with a cut-off value (λc)=0.8 mm, a measurement length=2.5 mm and a measurement rate=0.1 mm/sec. The sample to be measured was placed on a glass plate having a surface roughness Ra=0.05 or less so as to contact the surface which is not measured of the surface-treated sheet 7 having a light scattering function with the surface of the glass plate, and the surface roughnesses were measured at the center portions and the portions 5 mm and 10 mm distant from the center portion (up and down directions) of the by selecting 5 points in total of the surface-treated sheet 7 having a light scattering function, and an average value of the five points was made Ra.

<(III) Step of developing the phosphor-containing photosensitive resin composition layer (A) by removing the portion to which the scattered light is imagewisely irradiated to form a pattern>

Next, after irradiation of the active light, the material was allowed to stand at normal temperature for one hour, and then, subjected to spray development by using 1% by weight aqueous sodium carbonate solution at 30° C. for 120 seconds.

After development, the material was dried at 80° C. for 10 minutes and UV-ray irradiation with 3 J/cm$^2$ was carried out by using a Toshiba UV-ray irradiating machine (trade name, available from Toshiba Denzai), and further dried at 150° C. for one hour in a drying device.

<(IV) Step of calcinating the formed pattern to remove an unnecessary portion from the pattern formed in the step (III) to form a phosphor pattern>

Next, heat treatment (calcination) was carried out at 550° C. for 30 minutes to remove an unnecessary resin component whereby a phosphor pattern was formed on the inner surface of the concave portion of the substrate for PDP.

A sectional view of the resulting phosphor pattern was observed by a stereo microscope and SEM with naked eyes to evaluate the formed state of the phosphor pattern. The results are shown in Table 8 mentioned below.

Example 2

<(I) Step of forming a phosphor-containing photosensitive resin composition layer (A) on a substrate having unevenness>

At a side on which a barrier rib (a striped barrier rib, opening width of barrier rib: 150 μm, width of barrier rib: 70 μm, height of barrier rib: 150 μm) was formed, of a substrate for PDP, Photosensitive element (A-1) including the phosphor-containing photosensitive resin composition layer (A) obtained in Preparation example 2 was laminated by using a vacuum laminator (trade name: VLM-1 Model, produced by Hitachi Chemical Co., Ltd.) at a heat shoe temperature of 30° C. and a lamination rate of 0.5 m/min under an atmospheric pressure of 4,000 Pa or less and a contact bonding pressure (cylinder pressure) of $5\times10^4$ Pa (since a substrate having a thickness of 3 mm, a length of 10 cm and a width of 10 cm was used, line pressure at this time was $2.4\times10^3$ N/m) while the polyethylene film of Photosensitive element (A-1) was peeled off.

Then, the polyethylene terephthalate film of Photosensitive element (A-1) having the phosphor-containing photosensitive resin composition layer (A) was peeled off. On the phosphor-containing photosensitive resin composition layer (A), Film (B-1) having the thermoplastic resin layer (B) obtained in Preparation example 3 was laminated, while peeling off the polyethylene film, by using a laminator (trade name: HLM-3000 Model, produced by Hitachi Chemical Co., Ltd.) at a lamination temperature of 110° C. and a lamination rate of 0.5 m/min under a contact bonding pressure (guage pressure (cylinder pressure, normal pressure of 1 atm being 0)) of $4\times10^5$ Pa (since a substrate having a thickness of 3 mm, a length of 10 cm and a width of 10 cm was used, line pressure at this time was $9.8\times10^3$ N/m).

<(IIa) Step of irradiating active light to the phosphor-containing photosensitive resin composition layer (A) through a photomask provided on the photosensitive resin composition layer and a sheet having a light scattering function provided on the photomask>

Then, a photomask having an active light transmission width which is 15 μm narrower than the opening width of 150 μm between the barrier ribs was closely contacted onto Film (B-1) having the thermoplastic resin layer (B) so as to place the center of the active light transmission width of the photomask at the center of the opening width between barrier ribs and a sheet having a light scattering function (a ground glass with a thickness of 2 mm, surface roughness Ra=1.28 μm) was laminated thereon so as to contact the unevenness surface thereof with the photomask side, and the laminated material was irradiated imagewisely by active light of 600 mJ/cm$^2$ using HMW-201GX type exposure machine (trade name, available from ORC Seisakusho).

<(III) Step of developing the phosphor-containing photosensitive resin composition layer (A) by removing the portion to which the scattered light is imagewisely irradiated to form a pattern>

Next, after irradiation of the active light, the material was allowed to stand at normal temperature for one hour, and then, the polyethylene terephthalate film of Film (B-1) having the thermoplastic resin layer (B) was peeled off, and the resulting material was subjected to spray development by using 1% by weight aqueous sodium carbonate solution at 30° C. for 120 seconds.

After development, the material was dried at 80° C. for 10 minutes and UV-ray irradiation with 3 J/cm$^2$ was carried out by using a Toshiba UV-ray irradiating machine (trade name, available from Toshiba Denzai), and further dried-at 150° C. for one hour in a drying device.

<(IV) Step of calcinating the formed pattern to remove an unnecessary portion from the pattern formed in the step (III) to form a phosphor pattern>

Next, heat treatment (calcination) was carried out at 550° C. for 30 minutes to remove an unnecessary resin component whereby a phosphor pattern was formed on the inner surface of the concave portion of the substrate for PDP.

A sectional view of the resulting phosphor pattern was observed in the same manner as in Example 1 and the formed state of the phosphor pattern was evaluated. The results are shown in Table 8 mentioned below.

Example 3

In the same manner as in Example 2 except for changing Photosensitive element (A-1) having the phosphor-containing photosensitive resin composition layer (A) to Photosensitive element (A-2) having the phosphor-containing photosensitive resin composition layer (A) prepared in Preparation example 3, changing Film (B-1) having the thermoplastic resin layer (B) to Film (B-2) having the thermoplastic resin layer (B) prepared in Preparation example 6 and changing the step (IIa) to that shown below, a phosphor pattern was formed. The resulting phosphor pattern was evaluated in the same manner as in Example 1 and the results are shown in Table 8.

<(IIa) Step of irradiating active light to the phosphor-containing photosensitive resin composition layer (A) through a photomask provided on the photosensitive resin composition layer and a sheet having a light scattering function provided on the photomask>

Then, a photomask having an active light transmission width which is 35 μm narrower than the opening width of 150 μm between the barrier ribs was closely contacted onto Film (B-2) having the thermoplastic resin layer (B) so as to place the center of the active light transmission width of the photomask at the center of the opening width between barrier ribs and a sheet having a light scattering function (available from ORC Seisakusho, Quilting Meiler, trade name, surface roughness Ra=3.65 μm, film thickness: 80 μm ) was laminated thereon, and the laminated material was irradiated imagewisely by active light of 400 mJ/cm$^2$ using HMW-201GX type exposure machine (trade name, available from ORC Seisakusho).

Example 4

In the same manner as in Example 3 except for changing Photosensitive element (A-2) having the phosphor-containing photosensitive resin composition layer (A) to Photosensitive element (A-3) having the phosphor-containing photosensitive resin composition layer (A) prepared in Preparation example 4, changing Film (B-2) having the thermoplastic resin layer (B) to Film (B-3) having the thermoplastic resin layer (B) prepared in Preparation example 7 and changing the step (III) to that shown below, a phosphor pattern was formed. The resulting phosphor pattern was evaluated in the same manner as in Example 1 and the results are shown in Table 8.

<(III) Step of developing the phosphor-containing photosensitive resin composition layer (A) by removing the portion to which the scattered light is imagewisely irradiated to form a pattern>

Next, after irradiation of the active light, the material was allowed to stand at normal temperature for one hour, and then, subjected to spray development by using an emulsion comprising 3-methyl-3-methoxybutyl acetate and water (3-methyl-3-methoxybutyl acette/water (weight ratio)=25/75) at 30° C. for 70 seconds.

After development, the material was dried at 80° C. for 10 minutes and UV-ray irradiation with 3 J/cm$^2$ was carried out by using a Toshiba UV-ray irradiating machine (trade name, available from Toshiba Denzai), and further dried at 150° C. for one hour in a drying device.

Example 5

In the same manner as in Example 1 except for changing the step (IIa) to the step (IIb) shown below, a phosphor pattern was formed. A sectional view of the resulting phosphor pattern was observed in the same manner as in Example 1 and the formed state of the phosphor pattern was evaluated. The results are shown in Table 8 mentioned below.

<(IIb) Step of irradiating active light to the phosphor-containing photosensitive resin composition layer (A)

through a sheet having a light scattering function provided on the photosensitive resin composition layer and a photomask provided on the sheet>

Then, a sheet having a light scattering function (available from ORC Seisakusho, Quilting Meiler, trade name, surface roughness Ra=3.65 Mm, film thickness: 80 μm) was closely contacted onto the phosphor-containing photosensitive resin composition layer (A) and a photomask having an active light transmission width which is 15 μm narrower than the opening width of 150 μm between the barrier ribs was laminated thereon so as to place the center of the active light transmission width of the photomask at the center of the opening width between barrier ribs, and the laminated material was irradiated imagewisely by active light of 400 mJ/cm$^2$ using HMW-201GX type exposure machine (trade name, available from ORC Seisakusho).

Example 6

In the same manner as in Example 2 except for changing the step (IIa) to the step (IIb) shown below, a phosphor pattern was formed. A sectional view of the resulting phosphor pattern was observed in the same manner as in Example 1 and the formed state of the phosphor pattern was evaluated. The results are shown in Table 8 mentioned below.

<(IIb) Step of irradiating active light to the phosphor-containing photosensitive resin composition layer (A) through a sheet having a light scattering function provided on the photosensitive resin composition layer and a photomask provided on the sheet>

Then, a sheet having a light scattering function (a quartz glass with a thickness of 3 mm, one surface of which is made uneven by using No. 120 sandpaper, surface roughness Ra=2.51 μm) was closely contacted onto Film (B-1) having the thermoplastic resin layer (B) so as to contact the uneven surface with the polyethylene terephthalate film side and a photomask having an active light transmission width which is 15 μm narrower than the opening width of 150 μm between the barrier ribs was laminated thereon so as to place the center of the active light transmission width of the photomask at the center of the opening width between barrier ribs, and the laminated material was irradiated imagewisely by active light of 400 mJ/cm$^2$ using HMW-201GX type exposure machine (trade name, available from ORC Seisakusho).

Example 7

In the same manner as in Example 3 except for changing the step (IIa) to the step (IIb) shown below, a phosphor pattern was formed. A sectional view of the resulting phosphor pattern was observed in the same manner as in Example 1 and the formed state of the phosphor pattern was evaluated. The results are shown in Table 8 mentioned below.

<(IIb) Step of irradiating active light to the phosphor-containing photosensitive resin composition layer (A) through a sheet having a light scattering function provided on the photosensitive resin composition layer and a photomask provided on the sheet>

Then, a sheet of a light scattering substance (available from ORC Seisakusho, Quilting Meiler, trade name, surface roughness Ra=3.65 μm, film thickness: 80 μm) was closely contacted onto Film (B-2) having the thermoplastic resin layer (B) and a photomask having an active light transmission width which is 35 μm narrower than the opening width of 150 μm between the barrier ribs was laminated thereon so as to place the center of the active light transmission width of the photomask at the center of the opening width between barrier ribs, and the laminated material was irradiated imagewisely by active light of 400 mJ/cm$^2$ using HMW-201GX type exposure machine (trade name, available from ORC Seisakusho).

Example 8

In the same manner as in Example 4 except for changing the step (IIa) to the step (IIb) shown below, a phosphor pattern was formed. A sectional view of the resulting phosphor pattern was observed in the same manner as in Example 1 and the formed state of the phosphor pattern was evaluated. The results are shown in Table 8 mentioned below.

<(IIb) Step of irradiating active light to the phosphor-containing photosensitive resin composition layer (A) through a sheet having a light scattering function provided on the photosensitive resin composition layer and a photomask provided on the sheet>

Then, a sheet of a light scattering substance (available from ORC Seisakusho, Quilting Meiler, trade name, surface roughness Ra=3.65 μm, film thickness: 80 μm) was closely contacted onto Film (B-2) having the thermoplastic resin layer (B) and a photomask having an active light transmission width which is 25 μm narrower than the opening width of 150 μm between the barrier ribs was laminated thereon so as to place the center of the active light transmission width of the photomask at the center of the opening width between barrier ribs, and the laminated material was irradiated imagewisely by active light of 400 mJ/cm$^2$ using HMW-201GX type exposure machine (trade name, available from ORC Seisakusho).

Example 9

In the same manner as in Example 1 except for changing the step (IIa) to the step (IIc) shown below, a phosphor pattern was formed. A sectional view of the resulting phosphor pattern was observed in the same manner as in Example 1 and the formed state of the phosphor pattern was evaluated. The results are shown in Table 8 mentioned below.

<(IIc) Step of irradiating active light to the phosphor-containing photosensitive resin composition layer (A) through a photomask in which the light transmission portion has a light scattering function provided on the photosensitive resin composition layer>

Then, onto the phosphor-containing photosensitive resin composition layer (A), a photomask (surface roughness Ra at the active light transmission portion=3.65 μm) having an active light transmission width which is 15 μm narrower than the opening width of 150 μm between the barrier ribs which were prepared by providing a light non-transmission region to a light-scattering substance sheet (available from ORC Seisakusho, Quilting Meiler, trade name, surface roughness Ra=3.65 μm, film thickness: 80 μm) was laminated and closely contacted so as to place the center of the active light transmission width of the photomask at the center of the opening width between barrier ribs, and the laminated material was irradiated imagewisely by active light of 400 mJ/cm$^2$ using HMW-201GX type exposure machine (trade name, available from ORC Seisakusho).

Example 10

In the same manner as in Example 2 except for changing the step (IIa) to the step (IIc) shown below, a phosphor pattern was formed. A sectional view of the resulting phosphor pattern was observed in the same manner as in Example 1 and the formed state of the phosphor pattern was evaluated. The results are shown in Table 8 mentioned below.

<(IIc) Step of irradiating active light to the phosphor-containing photosensitive resin composition layer (A) through a photomask in which the light transmission portion has a light scattering function provided on the photosensitive resin composition layer>

Then, onto the polyethylene terephthalate film of Film (B-1) containing the thermoplastic resin layer (B), a photomask (surface roughness Ra at the active light transmission portion=2.5 μm) having an active light transmission width which is 15 μm narrower than the opening width of 150 μm between the barrier ribs which were prepared by providing a light non-transmission region to a light-scattering substance sheet (a quartz glass with a thickness of 3 mm, one surface of which is made uneven by using No. 120 sandpaper) was laminated and closely contacted so as to place the center of the active light transmission width of the photomask at the center of the opening width between barrier ribs, and the laminated material was irradiated imagewisely by active light of 600 mJ/cm$^2$ using HMW-201GX type exposure machine (trade name, available from ORC Seisakusho).

Example 11

In the same manner as in Example 3 except for changing the step (IIa) to the step (IIc) shown below, a phosphor pattern was formed. A sectional view of the resulting phosphor pattern was observed in the same manner as in Example 1 and the formed state of the phosphor pattern was evaluated. The results are shown in Table 8 mentioned below.

<(IIc) Step of irradiating active light to the phosphor-containing photosensitive resin composition layer (A) through a photomask in which the light transmission portion has a light scattering function provided on the photosensitive resin composition layer>

Then, onto the polyethylene terephthalate film of Film (B-2) containing the thermoplastic resin layer (B), a photo-J mask (surface roughness Ra at the active light transmission portion =3.65 μm) having an active light transmission width which is 35 μm narrower than the opening width of 150 μm between the barrier ribs which were prepared by providing a light non-transmission region to a light-scattering substance sheet (available from ORC Seisakusho, Quilting Meiler, trade name, surface roughness Ra=3.65 μm, film thickness: 80 μm) was laminated and closely contacted so as to place the center of the active light transmission width of the photomask at the center of the opening width between barrier ribs, and the laminated material was irradiated imagewisely by active light of 400 mJ/cm$^2$ using HMW-201GX type exposure machine (trade name, available from ORC Seisakusho).

Example 12

In the same manner as in Example 4 except for changing the step (IIa) to the step (IIc) shown below, a phosphor pattern was formed. A sectional view of the resulting phosphor pattern was observed in the same manner as in Example 1 and the formed state of the phosphor pattern was evaluated. The results are shown in Table 8 mentioned below.

<(IIc) Step of irradiating active light to the phosphor-containing photosensitive resin composition layer (A) through a photomask in which the light transmission portion has a light scattering function provided on the photosensitive resin composition layer>

Then, onto the polyethylene terephthalate film of Film (B-2) containing the thermoplastic resin layer (B), a photomask (surface roughness Ra at the active light transmission portion=3.65 μm) having an active light transmission width which is 25 μm narrower than the opening width of 150 μm between the barrier ribs which were prepared by providing a light non-transmission region to a light-scattering substance sheet (available from ORC Seisakusho, Quilting Meiler, trade name, surface roughness Ra=3.65 μm, film thickness: 80 μm) was laminated and closely contacted so as to place the center of the active light transmission width of the photomask at the center of the opening width between barrier ribs, and the laminated material was irradiated imagewisely by active light of 400 mJ/cm$^2$ using HMW-201GX type exposure machine (trade name, available from ORC Seisakusho).

Example 13

In the same manner as in Example 1 except for changing the step (IIa) to that shown below, a phosphor pattern was formed.

A sectional view of the resulting phosphor pattern was observed in the same manner as in Example 1 and the formed state of the phosphor pattern was evaluated. The results are shown in Table 8 mentioned below.

<(IIa) Step of irradiating active light to the phosphor-containing photosensitive resin composition layer (A) through a photomask provided on the photosensitive resin composition layer and a sheet having a light scattering function provided on the photomask>

Then, a photomask having an active light transmission width which is 15 μm narrower than the opening width of 150 μm between the barrier ribs was closely contacted onto the phosphor-containing photosensitive resin composition layer (A) so as to place the center of the active light transmission width of the photomask at the center of the opening width between barrier ribs and a sheet having a light scattering function (available from Teijin, Sand Matte Film PS-25-20%, trade name, film thickness: 25 μm, one surface matte treatment, surface roughness Ra=0.35 μm) was laminated thereon to closely contact, and the laminated material was irradiated imagewisely by active light of 400 mJ/cm$^2$ using HMW-201GX type exposure machine (trade name, available from ORC Seisakusho).

Example 14

In the same manner as in Example 1 except for changing the step (IIa) to that shown below, a phosphor pattern was formed.

A sectional view of the resulting phosphor pattern was observed in the same manner as in Example 1 and the formed state of the phosphor pattern was evaluated. The results are shown in Table 8 mentioned below.

<(IIa) Step of irradiating active light to the phosphor-containing photosensitive resin composition layer (A) through a photomask provided on the photosensitive resin composition layer and a sheet having a light scattering function provided on the photomask>

Then, a photomask having an active light transmission width which is 15 μm narrower than the opening width of 150 μm between the barrier ribs was closely contacted onto the phosphor-containing photosensitive resin composition layer (A) so as to place the center of the active light transmission width of the photomask at the center of the opening width between barrier ribs and a sheet having a light scattering function (available from Teijin, Sand Matte Film PS-25-12%, trade name, film thickness: 25 μm, one surface matte treatment, surface roughness Ra=0.49 μm) was laminated thereon to closely contact, and the laminated material was irradiated imagewisely by active light of 400 mJ/cm$^2$ using HMW-201GX type exposure machine (trade name, available from ORC Seisakusho).

Example 15

In the same manner as in Example 2 except for changing the step (IIa) to that shown below, a phosphor pattern was formed.

A sectional view of the resulting phosphor pattern was observed in the same manner as in Example 1 and the formed state of the phosphor pattern was evaluated. The results are shown in Table 8 mentioned below.

<(IIa) Step of irradiating active light to the phosphor-containing photosensitive resin composition layer (A) through a photomask provided on the photosensitive resin composition layer and a sheet having a light scattering function provided on the photomask>

Then, a photomask having an active light transmission width which is 15 μm narrower than the opening width of 150 μm between the barrier ribs was closely contacted onto the phosphor-containing photosensitive resin composition layer (A) so as to place the center of the active light transmission (B) width of the photomask at the center of the opening width between barrier ribs and a sheet having a light scattering function (a ground glass with a thickness of 2 mm, surface roughness Ra=1.5 μm) was provided so that the uneven surface faces to the photomask side and 10 mm aparts from the photomask, and the material was irradiated imagewisely by active light of 400 mJ/cm$^2$ using HMW-201GX type exposure machine (trade name, available from ORC Seisakusho).

Comparative Example 1

In the same manner as in Example 1 except for changing the step (II) to the step (IIp) as shown below. A sectional view of the resulting phosphor pattern was observed in the same manner as in Example 1 and the formed state of the phosphor pattern was evaluated. The results are shown in Table 8 mentioned below.

<(IIp) Step of irradiating active light imagewisely to the phosphor-containing photosensitive resin composition layer (A) through a photomask>

Then, onto the phosphor-containing photosensitive resin composition layer (A), a photomask having an active light transmission width which is 15 μm narrower than the opening width of 150 μm between the barrier ribs was closely contaced so as to place the center of the active light transmission width of the photomask at the center of the opening width between barrier ribs, and the material was irradiated imagewisely by active light of 400 mJ/cm$^2$ using HMW-201GX type exposure machine (trade name, available from ORC Seisakusho).

Comparative Example 2

In the same manner as in Example 2 except for changing the step (II) to the step (IIq) as shown below. A sectional view of the resulting phosphor pattern was observed in the same manner as in Example 1 and the formed state of the phosphor pattern was evaluated. The results are shown in Table 8 mentioned below.

<(IIq) Step of irradiating active light imagewisely to the phosphor-containing photosensitive resin composition layer (A) through a photomask>

Then, onto the polyethylene terephthalate film of Film (B-1) having the thermoplastic resin layer (B), a photomask having an active light transmission width which is 15 μm narrower than the opening width of 150 μm between the barrier ribs was closely contaced so as to place the center of the active light transmission width of the photomask at the center of the opening width between barrier ribs, and the material was irradiated imagewisely by active light of 600 mJ/cm$^2$ using HMW-201GX type exposure machine (trade name, available from ORC Seisakusho).

Comparative Example 3

In the same manner as in Example 3 except for changing the step (II) to the step (IIr) as shown below. A sectional view of the resulting phosphor pattern was observed in the same manner as in Example 1 and the formed state of the phosphor pattern was evaluated. The results are shown in Table 8 mentioned below.

<(IIr) Step of irradiating active light imagewisely to the phosphor-containing photosensitive resin composition layer (A) through a photomask>

Then, onto the polyethylene terephthalate film of Film (B-2) having the thermoplastic resin layer (B), a photomask having an active light transmission width which is 35 μm narrower than the opening width of 150 μm between the barrier ribs was closely contaced so as to place the center of the active light transmission width of the photomask at the center of the opening width between barrier ribs, and the material was irradiated imagewisely by active light of 400 mJ/cm$^2$ using HMW-201GX type exposure machine (trade name, available from ORC Seisakusho).

Comparative Example 4

In the same manner as in Example 4 except for changing the step (II) to the step (IIs) as shown below. A sectional view of the resulting phosphor pattern was observed in the same manner as in Example 1 and the formed state of the phosphor pattern was evaluated. The results are shown in Table 8 mentioned below.

<(IIs) Step of irradiating active light imagewisely to the phosphor-containing photosensitive resin composition layer (A) through a photomask>

Then, onto the polyethylene terephthalate film of Film (B-3) having the thermoplastic resin layer (B), a photomask having an active light transmission width which is 25 μm narrower than the opening width of 150 μm between the barrier ribs was closely contaced so as to place the center of the active light transmission width of the photomask at the center of the opening width between barrier ribs, and the material was irradiated imagewisely by active light of 400 mJ/cm$^2$ using HMW-201GX type exposure machine (trade name, available from ORC Seisakusho).

TABLE 8

| | Embodiment of Step (II) | Formability of Phosphor pattern |
|---|---|---|
| Examples 1 to 4 and 13 to 15 | (IIa) | ◎ |
| Examples 5 to 8 | (IIb) | ○ |
| Examples 9 to 12 | (IIc) | ◎ |
| Comparative examples 1 to 4 | No scattered light used | X |

Evaluation standard of the formability of phosphor pattern is as mentioned below.

◎: A phosphor layer is uniformly formed on the inner surface (wall surface of the barrier ribs and substrate surface) of the substrate for PDP O: A phosphor layer is substantially uniformly formed on the inner surface (wall surface of the barrier ribs and substrate surface) of the substrate for PDP X: A phosphor layer is not uniformly formed on the inner surface (wall surface of the barrier ribs and substrate surface) of the substrate for PDP From Table 8, it can be understood that Examples 1 to 15 in which a scattered light is imagewisely irradiated are excellent in formability (which is a property in which a phosphor pattern can be formed in uniform thickness only on the inner surface of concave portion surrounded by the wall surface of the barrier ribs and substrate surface for PDP) of a phosphor pattern on the inner surface of the concave portion of the substrate for PDP.

Figure 9:
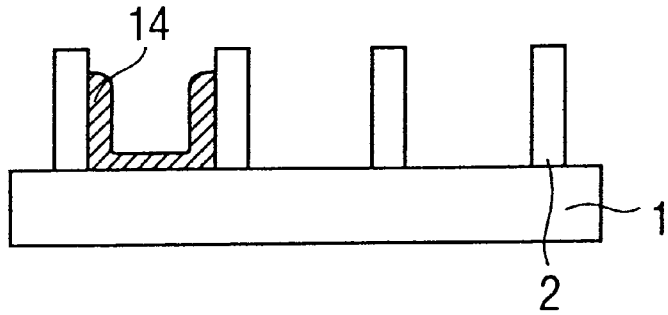
FIG. 9 is a schematic view showing the state of forming a phosphor pattern without using a sheet having a light scattering function.

On the other hand, in Comparative examples 1 to 4 in which active light is imagewisely irradiated through a photomask without using a scattered light, the photosensitive resin layer containing a phosphor at the wall portions of the barrier ribs are erroded as shown in FIG. 9 so that it can be understood that formability of the phosphor pattern on the inner surface of the concave portion of the substrate for PDP is not so good since the phosphor pattern cannot be formed with a uniform film thickness on the inner surface of the concave portion surrounded by the wall surface of the barrier ribs and substrate surface. The reference numeral 14 in FIG. 9 is a phorphor pattern in which the wall surfaces of the barrier ribs are erroded.

What is claimed is:

1. A process for preparing a phosphor pattern comprising the steps of:

(I) forming a phosphor-containing photosensitive resin composition layer (A) on a substrate having unevenness, (II) irradiating a scaattered light to the phosphor-containing photosensitive resin composition layer (A) imagewisely, (III) developing the phosphor-containing photosensitive resin composition layer (A) by removing the portion to which the scattered light is imagewisely irradiated to form a pattern, and (IV) calcinating the formed pattern to remove an unnecessary portion from the pattern formed in the step (III) to form a phosphor pattern.

2. The process according to claim 1, wherein the step (I) is a step of laminating a photosensitive element which has the phosphor-containing photosensitive resin composition layer (A) having a support so as to oppose the substrate having unevenness to the photosensitive resin composition layer (A) of the photosensitive laminate.

3. The process according to claim 1, wherein the step (II) is a step (IIa) which comprises irradiating active light to the phosphor-containing photosensitive resin composition layer (A) through a photomask provided on the photosensitive resin composition layer and a sheet having a light scattering function provided on the photomask.

4. The process according to claim 1, wherein the step (II) is a step (IIb) which comprises irradiating active light to the phosphor-containing photosensitive resin composition layer (A) through a sheet having a light scattering function provided on the photosensitive resin composition layer and a photomask provided on the sheet.

5. The process according to claim 1, wherein the step (II) is a step (IIc) which comprises irradiating active light to the phosphor-containing photosensitive resin composition layer (A) through a photomask in which the light transmission portion has a light scattering function provided on the photosensitive resin composition layer.

6. The process according to claim 1, wherein the substrate having unevenness includes a concave portion, and wherein the width of the photomask at the light transmission portion is narrower than that of an opening at the concave portion of the substrate.

7. The process according to claim 1, wherein the above steps (I) to (III) are repeated to form a multi-colored pattern comprising photosensitive resin composition layers containing phosphors which form colors of red, green and blue, and then the above step (IV) is subjected to form a multi-colored phosphor pattern.

8. The process according to claim 1, wherein the above steps (I) to (IV) are repeated to form a multi-colored phosphor pattern which forms colors of red, green and blue.

9. The process according to claim 1, wherein the phosphor-containing photosensitive resin composition layer (A) contains:

(a) a film property-imparting polymer, (b) a photopolymerizable unsaturated compound having an ethylenically unsaturated group, (c) a photopolymerization initiator which forms free radical by irradiation of the active light, and (d) a phosphor.

10. A phosphor pattern produced by the process according to claim 1 for preparing the phosphor pattern.

11. A back plate for a plasma display panel provided with the phosphor pattern according to claim 10 on a substrate for the plasma display panel.

12. The process according to claim 3, wherein said sheet is provided in contact with said photomask.

13. The process according to claim 3, wherein said sheet is provided spaced 0.3 to 30 cm from said photomask.

14. The process according to claim 3, wherein said sheet has an uneven surface so as to scatter the light.

15. The process according to claim 14, wherein the uneven surface of said sheet has a surface roughness Ra of at least 0.1 m.

16. The process according to claim 3, wherein said sheet contains fine particles so as to scatter the light.

17. The process according to claim 16, wherein the fine particles are contained in the sheet in an amount of 0.1 to 200% by volume based on the volume of the sheet.

18. The process according to claim 4, wherein said sheet has an uneven surface so as to scatter the light.

19. The process according to claim 4, wherein said sheet contains fine particles so as to scatter the light.

20. The process according to claim 5, wherein the photomask has an uneven surface so as to scatter the light.

21. The process according to claim 5, wherein the photomask contains fine particles so as to scatter the light.

22. The process according to claim 1, wherein in carrying out step (II) fine particles are spread out on the phosphor-containing photosensitive resin composition layer (A) to scatter the light.

23. A process for preparing a phosphor pattern comprising the steps of:

(I) forming a phosphor-containing photosensitive resin composition layer (A) on a substrate having unevenness, (II) irradiating a refracted light to the phosphor-containing photosensitive resin composition layer (A) imagewisely, (III) developing the phosphor-containing photosensitive resin composition layer (A) by removing the portion to which the refracted light is imagewisely irradiated to form a pattern, and (IV) calcinating the formed pattern to remove an unnecessary portion from the pattern formed in the step (III) to form a phosphor pattern.

24. A phosphor pattern produced by the process according to claim 23 for preparing the phosphor pattern.

25. A back plate for a plasma display panel provided with the phosphor pattern according to claim 24 on a substrate for the plasma display panel.

* * * * *